United States Patent [19]

Delquié

[11] Patent Number: 4,758,706

[45] Date of Patent: Jul. 19, 1988

[54] PARALLEL CORRUGATIONS FOR MATTER AND WELDER THEREOF

[76] Inventor: Maurice Delquié, 17, Boulevard Boigues, 58600 Fourchambault, France

[21] Appl. No.: 883,560

[22] Filed: Jul. 9, 1986

[30] Foreign Application Priority Data

Jul. 12, 1985 [FR] France ..... 85 10754

[51] Int. Cl.[4] ..... B23K 9/225

[52] U.S. Cl. ..... 219/125.1; 219/136

[58] Field of Search ..... 219/125.1, 126, 128, 219/136; 72/187, 190, 197, 214

[56] References Cited

FOREIGN PATENT DOCUMENTS

| | | | |
|---|---|---|---|
| 755074 | 2/1971 | Belgium | 219/125.1 |
| 601234 | 8/1934 | Fed. Rep. of Germany . | |
| 1452728 | 3/1969 | Fed. Rep. of Germany . | |
| 1552021 | 3/1971 | Fed. Rep. of Germany . | |
| 2825008 | 1/1979 | Fed. Rep. of Germany | 72/214 |
| 3310681 | 10/1983 | Fed. Rep. of Germany . | |
| 1294242 | 4/1961 | France . | |
| 2057236 | 5/1971 | France . | |
| 2517579 | 6/1983 | France . | |

*Primary Examiner*—Elliot Goldberg
*Assistant Examiner*—C. M. Sigda
*Attorney, Agent, or Firm*—McAulay, Fields, Fisher, Goldstein & Nissen

[57] ABSTRACT

A machine for forming parallel corrugations in a metal sheet and for welding each of these corrugations at its longitudinal end, comprises, on the metal sheet side, a bending die comprising two plates perpendicular to the metal sheet defining therebetween a space in which may be engaged a punch or knife perpendicular to the metal sheet. The bending die has, at each of its two lateral ends and on the internal faces opposite its parallel plates, a pair of bending members projecting from the internal faces of the two parallel plates of the die. These two bending members define therebetween a gap substantially equal to twice the thickness of the metal sheet. A welding torch is carried by the bending die and ensures welding of the two lips of the metal sheet in the immediate vicinity of the zone where they are nipped between the bending members.

15 Claims, 2 Drawing Sheets

PARALLEL CORRUGATIONS FOR MATTER AND WELDER THEREOF

BACKGROUND OF THE INVENTION

1. Field of the Invention

The present invention relates to a machine for forming parallel corrugations in a metal sheet, and for welding each of these corrugations at its longitudinal ends.

Metal sheets having parallel corrugations whose lips are welded at their ends are more especially used for forming walls of immersed electric transformers. In fact, these transformers include a tank containing the electric elements which is filled with a liquid dielectric which has the double function of isolating the coils through which the current flows and conveying away the heat dissipated by the transformer in operation. For removing this heat, the tank is provided with radiators of different designs. For the smallest powers, these radiators are formed by more or less deep and closely spaced undulations called corrugations and forming an integral part of the vertical walls of the tank. This technique is at present the most economical and it is more and more widely used.

To manufacture these corrugations in a panel, semi automatic manufacturing lines are used at the present time, the corrugated panels being fabricated in several successive operations so as to obtain a welded and so sealed assembly.

These manufacturing chains are very heavy and expensive and reserved for very large manufacturers.

2. Description of the prior art

A machine of the above mentioned type is already known, as described in the patent FR-A-2 245 427, comprising a bending die whose imprint has, in cross section, the desired shape for each of the corrugations to be formed in a metal sheet. This metal sheet is caused to pass in front of the die and on the side opposite this latter is located a punch or knife whose cross section is a little smaller than that of the die. Means are provided for moving the punch and/or the die perpendicularly to the metal sheet so that, following the movement engaging the punch in the die, the metal sheet is bent inside the die so as to form a corrugation.

SUMMARY OF THE INVENTION

The present invention relates to improvements to such a machine with the aim of welding together the endmost adjacent lips of the two sides of a corrugation, so as to close laterally the gap defined by each corrugation. To this end, this machine for forming parallel corrugations in a metal sheet and for welding each of these corrugations at its longitudinal ends, comprising, on the metal sheet side, a bending die comprising two plates perpendicular to the metal sheet defining therebetween a space in which may be engaged a punch or knife perpendicular to the metal sheet disposed on the other side thereof, means for causing relative movement perpendicular to the metal sheet of the bending die and of the knife so as to progressively engage this knife in the bending die and thus to fold the metal sheet into a U in the die for forming the corrugation, is characterized in that the bending die has, at each of its two lateral ends and on the internal faces opposite its parallel plates, a pair of bending members projecting from the internal faces of the two parallel plates of the die, the two bending members of the same pair being disposed inside the passage of the knife in the die, on each side of this passage, and defining therebetween a gap substantially equal to twice the thickness of the metal sheet for nipping therebetween, during the relative movement of the die and the knife, the two end lips opposite the sides of the metal sheet and welding means carried by the bending die and ensuring welding of the two lips of the metal sheet in the immediate vicinity of the zone where they are nipped between the bending members.

According to a complementary characteristic of the invention, the bending members are formed preferably by balls mounted fixedly or movably in spherical housings formed in the internal faces of the two plates of a bending die.

According to another complementary characteristic of the invention the welding means comprise preferably an electric blow torch carried by the bending die externally of the bending members, the axis of the output nozzle of this blow torch extending longitudinally, that is to say parallel to the crest of the corrugation, in the direction of the nipping zone between the two bending members and a little in front of the point where the two lips of the sides of the corrugation come into contact with each other between the bending members.

The machine of the invention offers the advantage that in a single operation panels may be obtained having corrugations welded at their lateral ends, whence a gain in manufacturing time and space saving. Moreover, this complete machine, providing both formation of the corrugation and welding, has a small volume, its cost price is relatively low and adjustment thereof is very easy since it is sufficient to adjust a single machine for varying the dimensions of the desired corrugated panel.

BRIEF DESCRIPTION OF THE DRAWINGS

One embodiment of the present invention will be described hereafter by way of non limitative example with reference to the accompanying drawings in which.

DESCRIPTION OF THE PREFERRED EMBODIMENT

Figure 1:
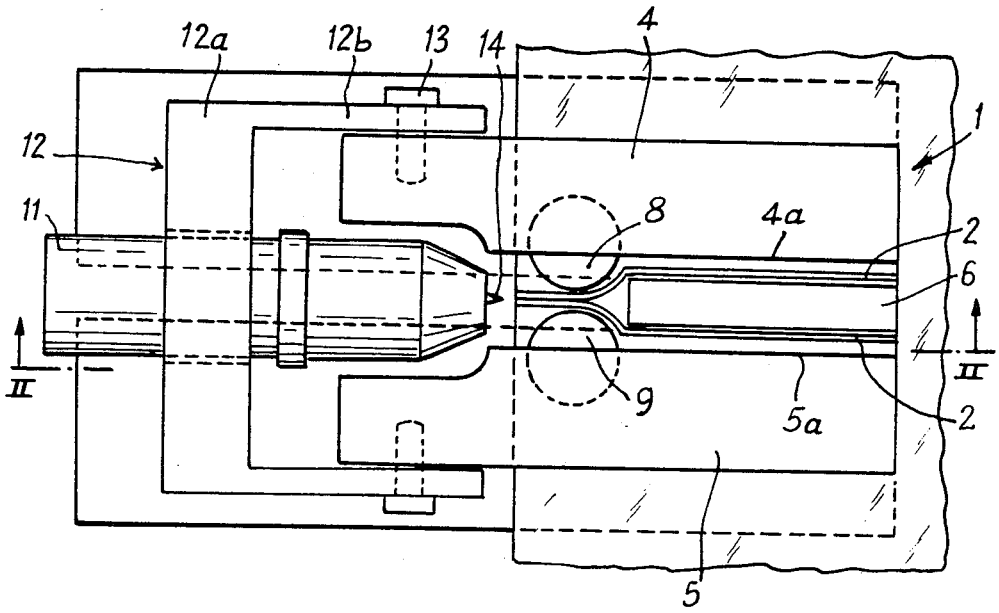
FIG. 1 is a half view in schematical horizontal section of the forming and welding of the machine of the invention.

The machine of the invention is intended to form, in a horizontal metal sheet 1, successive corrugations 2 parallel to each other and perpendicular to the plane of the metal sheet, these corrugations, forming, for example, cooling fins for a wall of a transformer. The machine comprises, as is shown in FIGS. 5 to 8, a die 3 formed essentially of two parallel vertical plates 4 and 5 this die being disposed for example above the metal sheet 1. Below the metal sheet 1 and the die 3 is disposed a punch or knife 6 which may be fixed and carried by a base 7 as is shown in the drawings. Means are provided, in the non limitative embodiment shown in the drawings, for vertically moving the die 3 so that the fixed knife 6 comes into engagement between the parallel vertical plates 4, 5 of the die, thus bending the metal sheets so as to form the parallel corrugations 2. However, it is obvious that the die 3 could be fixed, with knife 6 mobile or else the die 3 and the punch 6 could be both mobile.

Figure 2:
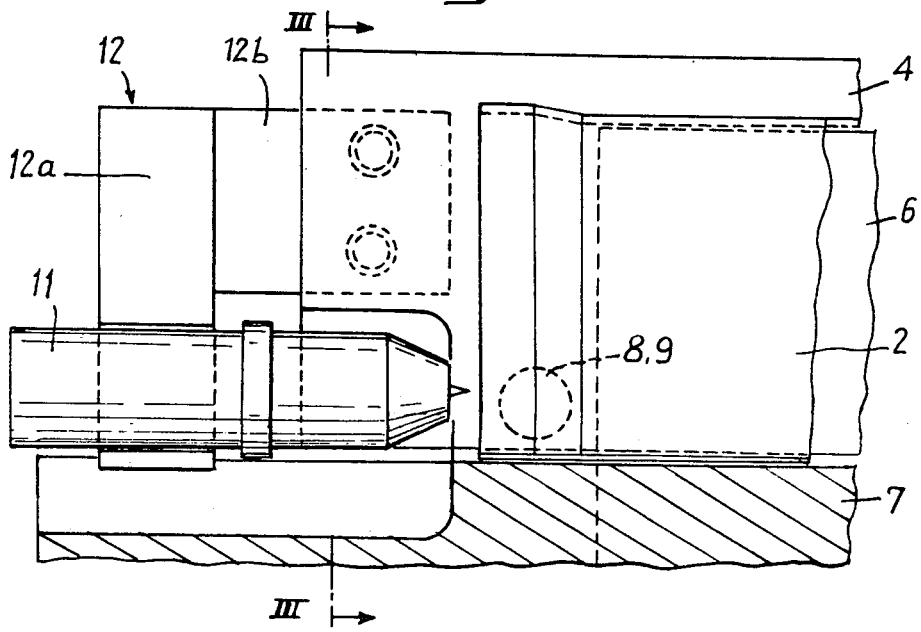
FIG. 2 is a view in vertical and longitudinal section with respect to the corrugation along the line II—II of FIG. 1.
Figure 3:
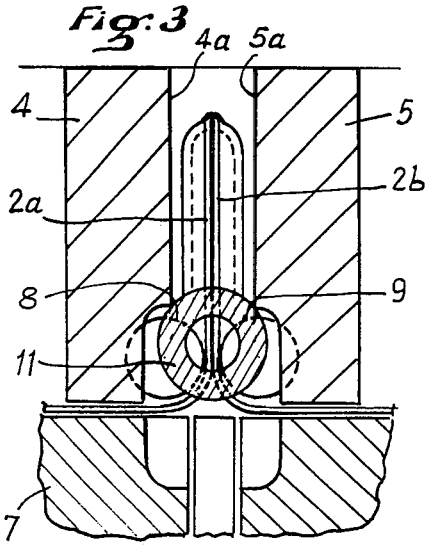
FIG. 3 is a view in vertical and cross section with respect to the corrugation along the line III—III of FIG. 2.
Figure 4:
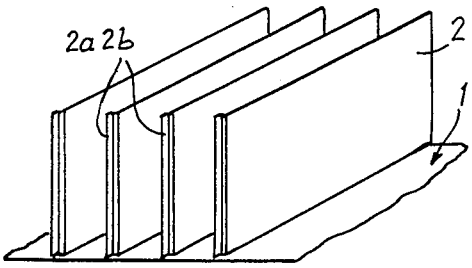
FIG. 4 is a partial perspective view of a finned cooling panel formed of parallel corrugations.
Figure 5:
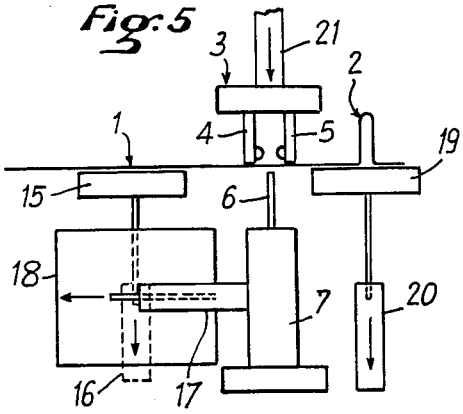
FIGS. 5, 6, 7 and 8 are schematical elevational views illustrating the different phases for manufacturing a panel with parallel corrugations using the machine of the invention.

Referring now more particularly to FIGS. 1 to 3, it can be seen that die 3 has, at each of its lateral ends and on the internal faces 4*a* and 5*a* of its two parallel plates 4 and 5, respective bending members 8 and 9 which, in this non limitative embodiment, are formed by balls. These balls are mounted fixedly or for rotation in spherical housings formed in the internal faces 4*a*, 5*a* of the two plates 4, 5 of the die. Balls 8, 9 are disposed outside the passage of the knife 6 in the die 3, on each side of this passage, so as to bend and apply the two end lips 2*a* and 2*b* of the two sides of each corrugation 2 against each other. To this end, the two balls of the same pair 8, 9 disposed opposite each other, in the same horizontal plane, are spaced apart from each other so as to define therebetween a gap of a width substantially equal to twice the thickness of the metal sheet. Thus, during the relative vertical movement of die 3 with respect to knife 6, the two balls 8, 9 of each pair of bending members cause the two lips 2*a*, 2*b* of the corrugation to be progressively drawn together and nipped as can be seen best in FIGS. 1 and 3.

The machine of the invention is also provided with means for welding the two lips 2*a*, 2*b* practically at the same time as they are nipped together. These welding means are advantageously formed by an electric blow torch 11 which is carried by die 3, externally of the bending members 8, 9. This blow torch extends horizontally, its axis being parallel to the crest of corrugation 2. The blow torch 11 is fixed to the vertical web 12*a* of a fork shaped support 12 whose vertical legs 12*b* enclose the two plates 4, 5 of die 3 and are fixed to the external faces of these plates by means of screws 13. The welding torch 11 comprises an outlet nozzle 14 which extends in the direction of the nipping zone between the two balls 8, 9, a little after the point where the two lips 2*a*, 2*b* of corrugation 2 come into contact with each other, between the two balls 8 and 9, as can be best seen in FIG. 3. Thus, the welding torch 11 causes the metal to begin to melt just a little after the application of pressure between the two balls 8 and 9.

It can be seen from the foregoing that the machine of the invention allows the corrugation 2 to be formed and its lateral lips 2*a* and 2*b* to be welded in a single operation, that is to say in a single stroke of relative movement of die 3 and knife 6.

Figure 6:
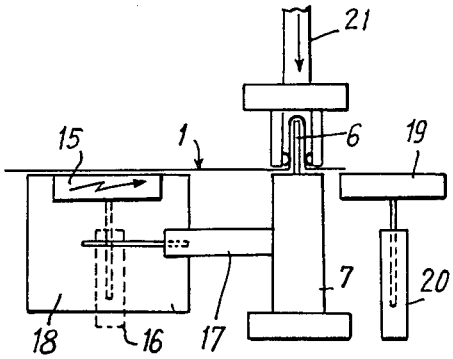
Figure 7:
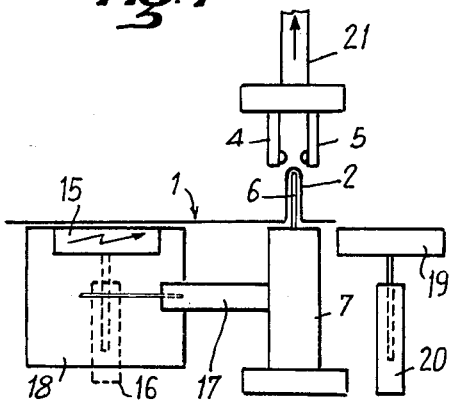

FIGS. 5 to 8 illustrate the operation of the machine. In the starting position, which is the one shown in FIG. 5, the metal sheet 1 rests, upstream of knife 6 and die 3, on an electromagnetic plate 15, in the high position, which may be moved vertically by a vertical actuating cylinder 16 carried by a carriage 18 moved horizontally by a horizontal actuating cylinder 17. Downstream of die 3 and knife 6, the metal sheet 5 rests on a plate 19 vertically movable under the control of a vertical actuating cylinder 20. For forming a corrugation 2, die 3 is lowered, under the control of a vertical press cylinder 21, so that its two vertical plates 5, 4 are engaged on each side of the fixed vertical knife 6, while bending the metal sheet 1 so as to form a corrugation 2 with inverted U shaped cross section. At the end of the downward movement of die 3, the metal sheet is deformed as is shown in FIG. 6. During this downward movement of die 3 the lateral sides 2*a*, 2*b* are nipped and welded as was explained above. Before deformation of metal sheet 1 takes place, for forming the corrugation 2, the plates 15 and 19 have been brought into their low positions, by their respective actuating cylinders 16 and 20. Moreover, carriage 18 carrying the electromagnetic plate 15 is brought back to its "retracted" position under the control of its actuator 17 connected to the press actuator controlling the downward movement of the die 3.

Figure 8:
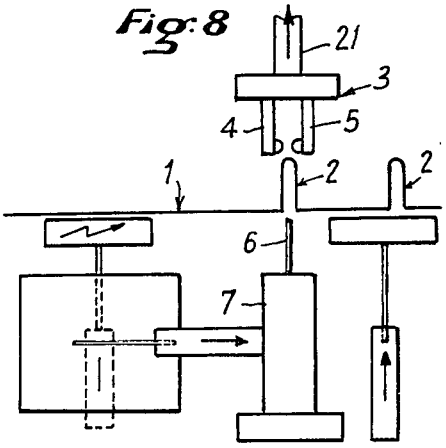

Once the metal sheet 1 has been bent for forming the corrugation 2 and the lips 2*a*, 2*b* of this corrugation have been welded, the press actuator 21 causes the die 3 to move up again which thus progressively frees the corrugation 2 formed on knife 6. At the end of the upward movement, the press actuator 21 controls the supply of actuators 16 and 20 through the bottom, which causes the electromagnetic plate 15 and the rear plate 19 to rise. These plates 15 and 19 then raise the metal sheet 1 while freeing the previously formed corrugation 2 from knife 6, as is shown in FIG. 8. The actuator 17 is then fed through the nose, under the control of the press actuator, for moving the carriage 18 and the electromagnetic plate 15 in the direction of knife 6. Because the electromagnetic plate 15 is then energized, it takes with it the metal sheet 1 so as to bring it into the starting position, for bending a new corrugation 2, this position being shown in FIG. 5. The cycle may then begin again.

What I claim is:

1. A machine for forming parallel corrugations in a metal sheet having first and second oppositely facing face sides and for welding each of the formed corrugations at its longitudinal ends, comprising:

a punch or knife positioned perpendicular to the second side of the metal sheet;

a bending die comprising two parallel plates each having an internal face positioned facing said punch or knife and perpendicular to the first side of the metal sheet and defining therebetween a space forming a passage within which said punch or knife may be engaged with the second side of the metal sheet;

means for imparting relative movement to said bending die perpendicularly to the first side of the metal sheet so as to engage said knife onto the second side of the metal sheet progressively between said two parallel plates of said bending die with the metal sheet between said bending die and said knife, and thus to fold the metal sheet into a U-shaped corrugation with a pair of legs formed in the metal sheet forming the sides of the corrugation and a base joining the pair of legs forming a crest of the corrugation between said two parallel plates in the die for forming a single corrugation;

said bending die including a pair of bending members at each of the lateral ends of said parallel plates, said pair of bending members projecting from the internal faces of said two parallel plates;

each of said pair of bending members of the same bending die being disposed outside of a passage for said knife and extending into said space between said parallel plates of said die, on each side of said passage, and said parallel plates defining therebetween a gap substantially equal to twice the thickness of the metal sheet between said first and second sides thereof for nipping therebetween, during the relative movement of said die and said knife and forming an end lip on each of said legs on the second side of the metal sheet;

welding means carried by said bending die for welding of each of said end lips of the metal sheet together in the immediate vicinity of a nipping zone where said end lips are nipped between said bending members; and spherical housings formed in said internal faces of each of said two parallel plates and outside of said passage for said knife;

said bending members being formed by balls mounted fixedly in said spherical housings.

2. A machine for forming parallel corrugations in a metal sheet having one side and another oppositely facing side and for welding each of the formed corrugations at its longitudinal ends, comprising:

a punch or knife positioned perpendicular to the one side of the metal sheet;

a bending die comprising two parallel plates each having an internal face positioned facing said punch or knife and perpendicular to the other side of the metal sheet and defining therebetween a space forming a passage within which said punch or knife may be engaged with the one side of the metal sheet;

means for imparting relative movement to said bending die perpendicularly to the other side of the metal sheet so as to engage said knife onto the one side of the metal sheet progressively between said two parallel plates of said bending die with the metal sheet between said bending die and said knife, and thus to fold the metal sheet into a U-shaped corrugation with a pair of legs formed in the metal sheet forming the sides of the corrugation and a base joining the pair of legs forming a crest of the corrugation between said two parallel plates in the die for forming a single corrugation;

said bending die including a pair of bending members at each of the lateral ends of said parallel plates, said pair of bending members projecting from the internal faces of said two parallel plates;

each of said pair of bending members of the same bending die being disposed outside of a passage for said knife and extending into said space between said parallel plates of said die, on each side of said passage, and said parallel plates defining therebetween a gap substantially equal to twice the thickness of the metal sheet between the one and the other sides thereof for nipping therebetween, during the relative movement of said die and said knife and forming an end lip on each of said legs on the one side of the metal sheet;

welding means carried by said bending die for welding of each of said end lips of the metal sheet together in the immediate vicinity of a nipping zone where said end lips are nipped between said bending members; and spherical housings formed in said internal faces of each of said two parallel plates and outside of said passage for said knife;

said bending members being formed by balls mounted movably in said spherical housings.

3. A machine according to claim 2, wherein:

said welding means comprises an electric blow torch carried by said bending die externally of said bending members; and said blow torch includes an output nozzle, and the axis of said output nozzle extends longitudinally in a direction parallel to the crest of the corrugation, in the direction of the nipping zone between the bending members and a little in front of a point where the two lips of the sides of the corrugation come into contact with each other between said bending members.

4. A machine according to claim 1, wherein:

said welding means comprises an electric blow torch carried by said bending die externally of said bending members; and said blow torch includes an output nozzle, and the axis of said output nozzle extends longitudinally in a direction parallel to the crest of the corrugation, in the direction of the nipping zone between the bending members and a little in front of a point where the two lips of the sides of the corrugation come into contact with each other between said bending members.

5. A machine according to claim 3, including:

external faces on said plates; and a fork-shaped support having vertical legs enclosing said two plates of said die and including screws fixing said fork-shaped support to said external faces of said plates.

6. A machine according to claim 4, including:

external faces on said plates; and a fork-shaped support having vertical legs enclosing said two plates of said die and including screws fixing said fork-shaped support to said external faces of said plates.

7. A machine according to claim 1, including:

an electromagnetic plate for supporting thereon the second side of the metal plate in a starting position upstream of said knife and said die in a first or high position;

a first vertical actuating cylinder for engagement with the second side of the metal plate for movement of the metal plate from a low position away from said bending die to the high position towards said bending die;

a carriage for carrying said vertical actuating cylinder, and a horizontal actuating cylinder for movement of said carriage and said vertical actuating cylinder carried by said carriage horizontally in a direction transverse to the movement of said vertical actuating cylinder; and a vertically movable plate for engagement with the second side of the metal plate downstream of said die and said knife on which the second side of the metal plate rests; and a second vertical actuating cylinder for controlling the vertical movement of said plate.

8. A machine according to claim 2, including:

an electromagnetic plate for supporting thereon the one side of the metal plate in a starting position upstream of said knife and said die in a first or high position;

a first vertical actuating cylinder for engagement with the one side of the metal plate for movement of the metal plate from a low position away from said bending die to the high position towards said bending die;

a carriage for carrying said vertical actuating cylinder, and a horizontal actuating cylinder for movement of said carriage and said vertical actuating cylinder carried by said carriage horizontally in a direction transverse to the movement of said vertical actuating cylinder;

a vertically movable plate for engagement with the one side of the metal plate downstream of said die and said knife on which the one side of the metal plate rests; and a second vertical actuating cylinder for controlling the vertical movement of said plate.

9. A machine according to claim 1, including:

an electromagnetic plate for supporting thereon the second side of the metal plate in a starting position upstream of said knife and said die in a first or high position;

a first vertical actuating cylinder for engagement with the second side of the metal plate for movement of the metal plate from a low position away from said bending die to the high position towards said bending die;

a carriage for carrying said vertical actuating cylinder, and a horizontal actuating cylinder for movement of said carriage and said vertical actuating cylinder carried by said carriage horizontally in a direction transverse to the movement of said vertical actuating cylinder;

a vertically movable plate for engagement with the second side of the metal plate downstream of said die and said knife on which the second side of the metal plate rests; and a second vertical actuating cylinder for controlling the vertical movement of said plate.

10. A machine according to claim 4, including:

an electromagnetic plate for supporting the metal plate in a starting position upstream of said knife and said die in a first or high position;

a first vertical actuating cylinder for engagement with the second side of the metal plate and said electromagnetic plate for movement thereof from a low position to the high position;

a carriage for carrying said first vertical actuating cylinder, and a horizontal actuating cylinder for movement of said carriage and said first vertical actuating cylinder carried by said carriage horizontally; and another plate for supporting the metal plate and being vertically movable under the control of a second vertical actuating cylinder downstream of said die and said knife on which the second side of the metal plate is supported.

11. A machine according to claim 5, including:

an electromagnetic plate for supporting the metal plate in a starting position upstream of said knife and said die in a first or high position;

a first vertical actuating cylinder for engagement with the one side of the metal plate and said electromagnetic plate for movement thereof from a low position to the high position;

a carriage for carrying said first vertical actuating cylinder, and a horizontal actuating cylinder for movement of said carriage and said first vertical actuating cylinder carried by said carriage horizontally; and another plate for supporting the metal plate and being vertically movable under the control of a second vertical actuating cylinder downstream of said die and said knife on which the one side of the metal plate is supported.

12. A machine according to claim 1, including:

external faces on said parallel plates; and a fork-shaped support having vertical legs enclosing said two parallel plates of said die and including screws fixing said fork-shaped support to said external faces of said parallel plates.

13. A machine according to claim 2, including:

external faces on said parallel plates; and a fork-shaped support having vertical legs enclosing said two parallel plates of said die and including screws fixing said fork-shaped suppport to said external faces of said parallel plates.

14. A machine according to claim 7, including:

external faces on said parallel plates; and a fork-shaped support having vertical legs enclosing said two parallel plates of said die and including screws fixing said fork-shaped support to said external faces of said parallel plates.

15. A machine according to claim 8, including:

external faces on said parallel plates; and a fork-shaped support having vertical legs enclosing said two parallel plates of said die and including screws fixing said fork-shaped support to said external faces of said parallel plates.

* * * * *